US009714041B2

(12) United States Patent
Oswald

(10) Patent No.: US 9,714,041 B2
(45) Date of Patent: Jul. 25, 2017

(54) TRAIN CONTROL SYSTEM AND METHOD

(71) Applicant: Westinghouse Air Brake Technologies Corporation, Wilmerding, PA (US)

(72) Inventor: James A. Oswald, Coggon, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 71 days.

(21) Appl. No.: 14/882,925

(22) Filed: Oct. 14, 2015

(65) Prior Publication Data

US 2017/0106884 A1 Apr. 20, 2017

(51) Int. Cl.
*B61L 25/02* (2006.01)
*B61L 15/00* (2006.01)

(52) U.S. Cl.
CPC ..... *B61L 15/0063* (2013.01); *B61L 15/0072* (2013.01); *B61L 25/02* (2013.01)

(58) Field of Classification Search
CPC ... B61L 15/0063; B61L 15/0072; B61L 25/02
See application file for complete search history.

(56) References Cited

U.S. PATENT DOCUMENTS

2010/0023190 A1 1/2010 Kumar et al.
2010/0235022 A1 9/2010 Siddappa et al.
2010/0299007 A1* 11/2010 Ghaly ..... B61L 3/008 701/20
2014/0180573 A1 6/2014 Rhea et al.
2014/0288734 A1 9/2014 Hawthorne et al.
2015/0232110 A1* 8/2015 Ghaly ..... B61L 27/0055 246/62
2016/0355199 A1* 12/2016 Kernwein ..... B61L 11/08

FOREIGN PATENT DOCUMENTS

WO 2014037549 A2 3/2014

* cited by examiner

*Primary Examiner* — Richard Camby
(74) *Attorney, Agent, or Firm* — The Webb Law Firm

(57) ABSTRACT

A control system for a train having at least one locomotive or control car and, optionally, at least one railroad car, operating in a track network, wherein an on-board computer determines or receives movement data and location data and generates stopping data representing an amount of force for stopping the train at a distance from a target and/or predictor data representing an estimated or predicted location or position of the train in the track network based on the movement data and the location data. A train control method is also provided.

28 Claims, 9 Drawing Sheets

TRAIN CONTROL SYSTEM AND METHOD

BACKGROUND OF THE INVENTION

Field of the Invention

Disclosed embodiments relate generally to vehicle systems and control processes, such as railway systems including trains travelling in a track or rail network, and in particular to a train control system and method that provide improved train control in railway networks, such as in connection with train control predictions and modeling, approaching stop targets, and the like.

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. These computer-controlled train management systems have on-board computers or controllers that are used to implement certain train control and management actions for ensuring safe and effective operation of the train.

A problematic aspect of PTC is that it can interfere with the ability of the crew (or other train control systems, such as an energy management system) to control the train. For example, PTC can interfere with the ability of the crew to control the train to approach a stop target, such as a switch or signal. The crew typically desires to stop the train as close to the stop target as possible, for example, in order to more clearly see a signal indication or switch position at the stop target, or to position the train such that its rear end is not extending beyond a track circuit, switch, or siding. However, this goal often conflicts with PTC behavior, which attempts to prevent the train from overrunning the stop target. For example, PTC includes a safety offset at which the train should be stopped before the stop target, and PTC is typically conservative in assumptions that it makes about current train control settings.

PTC does not know what future actions may be taken by the crew. If the crew throttles up one notch to creep closer to a stop target ahead, the crew knows that they plan to reduce the throttle in the near future, e.g., in a few seconds, as speed begins to increase. The crew may also know that they plan to apply locomotive independent brakes in the near future to help slow or stop the train. PTC does not know that the crew plans to take these future actions and, from a safety perspective, assumes that the control settings, e.g., the throttle up, will not be changed. For example, PTC may assume that the control settings do not change for a predetermined time period, e.g., 75 seconds. This puts PTC at a disadvantage in predicting and modeling the train behavior. Moreover, because PTC can only control the penalty brakes, it is forced to model train behavior that does not match real world behavior and actual train handling by the crew. PTC thus predicts a much larger increase in speed based on the crew's actions than was intended by the crew, which results in a longer braking curve and, ultimately, PTC issuing warnings and performing enforcement actions. This behavior by PTC makes it more difficult for the crew to approach a stop target and stop close to the target.

Similarly, PTC may not know how an energy management system (or other systems that control the train) plans to control the train during a future period of time. Accordingly, PTC predictions and modeling may be rendered less accurate and/or unnecessary nuisance warnings may be issued during implementation of an energy management plan.

For at least these reasons, there is a need in the art for an improved train control system and method.

SUMMARY OF THE INVENTION

Generally, provided are an improved train control system and computer-implemented method for use in connection with trains travelling in a track network. Preferably, provided are a train control system and computer-implemented method that provide an improved and accurate approach to a stop target for a train. Preferably, provided are a train control system and computer-implemented method that provide improved and accurate throttle and braking prediction, modeling, and control for a train travelling in a track network. Preferably, provided are an improved train control system and computer-implemented method that are useful in connection with or in commuter train operations, freight train operations, push-pull train configurations, terminal areas, track networks, and the like.

In one preferred and non-limiting embodiment or aspect, provided is a train control system for a train having at least one locomotive or control car and, optionally, at least one railroad car, operating in a track network, including: on the at least one locomotive or control car: an on-board computer programmed or configured to implement or facilitate at least one train action; a communication device in communication with the on-board computer and programmed or configured to receive, transmit, and/or process data signals; and at least one database in communication with the on-board computer with railway data stored therein; wherein the on-board computer of the at least one locomotive or control car is programmed or configured to: determine or receive movement data representing at least one of the following: a speed of the train, an acceleration of the train, or any combination thereof; determine or receive location data representing at least one of the following: the location or position of the train in the track network, the location or position of the at least one locomotive or control car in the track network, the location or position of the at least one railroad car in the track network, the location or position of a target in the track network, and the location or position of the target with respect to the location or position of the train in the track network or the location or position of the at least one locomotive or control car in the track network, or any combination thereof; and generate stopping data representing an amount of force for stopping the train at a distance from the target based on the movement data and the location data.

In another preferred and non-limiting embodiment or aspect, the on-board computer of the at least one locomotive or control car is programmed or configured to: determine or receive force data representing an amount of force for maintaining the speed of the train. In one preferred and non-limiting embodiment or aspect, the on-board computer of the at least one locomotive or control car is programmed or configured to: determine or receive throttle or braking data representing an amount of throttle application or an amount of brake application for providing the amount of force for maintaining the speed of the train. In another preferred and non-limiting embodiment or aspect, the on-board computer of the at least one locomotive or control car is programmed or configured to: communicate or cause the communication of a command to apply the throttle or the brake based on the throttle or braking data. In one preferred and non-limiting embodiment or aspect, the on-board computer of the at least one locomotive or control car is programmed or configured to: determine or receive movement data representing that the acceleration of the train is substantially zero, wherein the stopping data is generated based on the movement data representing that the acceleration of the train is substantially zero. In another preferred and non-limiting embodiment or aspect, the on-board computer of the at least one locomotive or control car is programmed or configured to: generate braking data representing an amount of brake application for providing the amount of force for stopping the train at the distance from the target.

In one preferred and non-limiting embodiment or aspect, the on-board computer of the at least one locomotive or control car is programmed or configured to: communicate or cause the communication of a command to apply the brake based on the braking data. In another preferred and non-limiting embodiment or aspect, the on-board computer of the at least one locomotive or control car is programmed or configured to: automatically communicate or cause the communication of a command to cancel the command to apply the brake based on the stopping data in response to a user action. In another preferred and non-limiting embodiment or aspect, the on-board computer of the at least one locomotive or control car is programmed or configured to: determine or receive movement data representing a deceleration of the train in response to the command to apply the brake based on the braking data; and generate predictor data representing where the train is estimated or predicted to stop in the track network based on the movement data representing the deceleration of the train. In one preferred and non-limiting embodiment or aspect, the on-board computer of the at least one locomotive or control car is programmed or configured to: adjust the braking data representing the amount of brake application for providing the amount of force for stopping the train at the distance from the target based on the predictor data. In another preferred and non-limiting embodiment or aspect, the on-board computer of the at least one locomotive or control car is programmed or configured to: prevent the communication or cause the communication of the command to apply the brake when at least one of the speed of the train violates a threshold speed and a distance of the location or position of the target with respect to the location or position of the train in the track network or the location or position of the at least one locomotive or control car in the track network violates a distance threshold. In one preferred and non-limiting embodiment or aspect, the location data further represents a grade of the track under at least a portion of the train.

In another preferred and non-limiting embodiment or aspect, provided is a computer-implemented train control method for a train having at least one locomotive or control car and, optionally, at least one railroad car, operating in a track network, including: determining or receiving movement data representing at least one of the following: a speed of the train, an acceleration of the train, or any combination thereof; determining or receiving location data representing at least one of the following: the location or position of the train in the track network, the location or position of the at least one locomotive or control car in the track network, the location or position of the at least one railroad car in the track network, the location or position of a target in the track network, and the location or position of the target with respect to the location or position of the train in the track network or the location or position of the at least one locomotive or control car in the track network, or any combination thereof; and generating stopping data representing an amount of force for stopping the train at a distance from the target based on the movement data and the location data.

In one preferred and non-limiting embodiment or aspect, the method further comprises determining or receiving force data representing an amount of force for maintaining the speed of the train. In another preferred and non-limiting embodiment or aspect, the method further comprises determining or receiving throttle or braking data representing an amount of throttle application or an amount of brake application for providing the amount of force for maintaining the speed of the train. In one preferred and non-limiting embodiment or aspect, the method further comprises communicating or causing the communication of a command to apply the throttle or the brake based on the throttle or braking data. In another preferred and non-limiting embodiment or aspect, the method further comprises determining or receiving movement data representing that the acceleration of the train is substantially zero, wherein the stopping data is generated based on the movement data representing that the acceleration of the train is substantially zero. In one preferred and non-limiting embodiment or aspect, the method further comprises generating braking data representing an amount of brake application for providing the amount of force for stopping the train at the distance from the target. In another preferred and non-limiting embodiment or aspect, the method further comprises communicating or causing the communication of a command to apply the brake based on the braking data.

In one preferred and non-limiting embodiment or aspect, the method further comprises automatically communicating or causing the communication of a command to cancel the command to apply the brake based on the stopping data in response to a user action. In another preferred and non-limiting embodiment or aspect, the method further comprises determining or receiving movement data representing a deceleration of the train in response to the command to apply the brake based on the braking data; and generating a predictor data representing where the train is estimated or predicted to stop in the track network based on the movement data representing the deceleration of the train. In one preferred and non-limiting embodiment or aspect, the method further comprises adjusting the braking data representing the amount of brake application for providing the amount of force for stopping the train at the distance from the target based on the predictor data. In another preferred and non-limiting embodiment or aspect, the method further comprises preventing the communication or cause the communication of the command to apply the brake when at least one of the speed of the train violates a threshold speed and a distance of the location or position of the target with respect to the location or position of the train in the track network or the location or position of the at least one locomotive or control car in the track network violates a distance threshold. In one preferred and non-limiting embodiment or aspect, the location data further represents a grade of the track under at least a portion of the train.

In another preferred and non-limiting embodiment or aspect, provided is a train control system for a train having at least one locomotive or control car and, optionally, at least one railroad car, operating in a track network, including, on the at least one locomotive or control car: an on-board computer programmed or configured to implement or facilitate at least one train action; a communication device in communication with the on-board computer and programmed or configured to receive, transmit, and/or process data signals; and at least one database in communication with the on-board computer with railway data stored therein; wherein the on-board computer of the at least one locomotive or control car is programmed or configured to: determine or receive management data representing at least one of the following planned for a future period of time: a brake application, a throttle application, or any combination thereof; determine or receive location data representing at least one of the following: the location or position of the train in the track network, the location or position of the at least one locomotive or control car in the track network, the location or position of the at least one railroad car in the track network, or any combination thereof; determine or receive movement data representing at least one of the following: a speed of the train, an acceleration of the train, or any combination thereof; and generate predictor data representing an estimated or predicted location or position of the train in the track network, the location or position of the at least one locomotive or control car in the track network, the location or position of the at least one railroad car in the track network, or any combination thereof during the future period of time based on the management data, the location data, and the movement data.

In one preferred and non-limiting embodiment or aspect, provided is a computer-implemented train control method for a train having at least one locomotive or control car and, optionally, at least one railroad car, operating in a track network, including: determining or receiving management data representing at least one of the following planned for a future period of time: a brake application, a throttle application, or any combination thereof; determining or receiving location data representing at least one of the following: the location or position of the train in the track network, the location or position of the at least one locomotive or control car in the track network, the location or position of the at least one railroad car in the track network, or any combination thereof; determining or receiving movement data representing at least one of the following: a speed of the train, an acceleration of the train, or any combination thereof; and generating predictor data representing an estimated or predicted location or position of the train in the track network, the location or position of the at least one locomotive or control car in the track network, the location or position of the at least one railroad car in the track network, or any combination thereof during the future period of time based on the management data, the location data, and the movement data.

Further embodiments or aspects will not be described and set forth in the following numbered clauses:

Clause 1. A train control system for a train having at least one locomotive or control car and, optionally, at least one railroad car, operating in a track network, the system comprising: on the at least one locomotive or control car: an on-board computer programmed or configured to implement or facilitate at least one train action; a communication device in communication with the on-board computer and programmed or configured to receive, transmit, and/or process data signals; and at least one database in communication with the on-board computer with railway data stored therein; wherein the on-board computer of the at least one locomotive or control car is programmed or configured to: determine or receive movement data representing at least one of the following: a speed of the train, an acceleration of the train, or any combination thereof; determine or receive location data representing at least one of the following: the location or position of the train in the track network, the location or position of the at least one locomotive or control car in the track network, the location or position of the at least one railroad car in the track network, the location or position of a target in the track network, and the location or position of the target with respect to the location or position of the train in the track network or the location or position of the at least one locomotive or control car in the track network, or any combination thereof; generate stopping data representing an amount of force for stopping the train at a distance from the target based on the movement data and the location data.

Clause 2. The system of clause 1, wherein the on-board computer of the at least one locomotive or control car is programmed or configured to: determine or receive force data representing an amount of force for maintaining the speed of the train.

Clause 3. The system of clause 1 or 2, wherein the on-board computer of the at least one locomotive or control car is programmed or configured to: determine or receive throttle or braking data representing an amount of throttle application or an amount of brake application for providing the amount of force for maintaining the speed of the train.

Clause 4. The system of any of clauses 1-3, wherein the on-board computer of the at least one locomotive or control car is programmed or configured to: communicate or cause the communication of a command to apply the throttle or the brake based on the throttle or braking data.

Clause 5. The system of any of clauses 1-4, wherein the on-board computer of the at least one locomotive or control car is programmed or configured to: determine or receive movement data representing that the acceleration of the train is substantially zero, wherein the stopping data is generated based on the movement data representing that the acceleration of the train is substantially zero.

Clause 6. The system of any of clauses 1-5, wherein the on-board computer of the at least one locomotive or control car is programmed or configured to: generate braking data representing an amount of brake application for providing the amount of force for stopping the train at the distance from the target.

Clause 7. The system of any of clauses 1-6, wherein the on-board computer of the at least one locomotive or control car is programmed or configured to: communicate or cause the communication of a command to apply the brake based on the braking data.

Clause 8. The system of any of clauses 1-7, wherein the on-board computer of the at least one locomotive or control car is programmed or configured to: automatically communicate or cause the communication of a command to cancel the command to apply the brake based on the stopping data in response to a user action.

Clause 9. The system of any of clauses 1-8, wherein the on-board computer of the at least one locomotive or control car is programmed or configured to: determine or receive movement data representing a deceleration of the train in response to the command to apply the brake based on the braking data; and generate predictor data representing where the train is estimated or predicted to stop in the track network based on the movement data representing the deceleration of the train.

Clause 10. The system of any of clauses 1-9, wherein the on-board computer of the at least one locomotive or control car is programmed or configured to: adjust the braking data representing the amount of brake application for providing the amount of force for stopping the train at the distance from the target based on the predictor data.

Clause 11. The system of any of clauses 1-10, wherein the on-board computer of the at least one locomotive or control car is programmed or configured to: prevent the communication or cause the communication of the command to apply the brake when at least one of the speed of the train violates a threshold speed and a distance of the location or position of the target with respect to the location or position of the train in the track network or the location or position of the at least one locomotive or control car in the track network violates a distance threshold.

Clause 12. The system of any of clauses 1-11, wherein the location data further represents a grade of the track under at least a portion of the train.

Clause 13. A computer-implemented train control method for a train having at least one locomotive or control car and, optionally, at least one railroad car, operating in a track network, the method comprising: determining or receiving movement data representing at least one of the following: a speed of the train, an acceleration of the train, or any combination thereof; determining or receiving location data representing at least one of the following: the location or position of the train in the track network, the location or position of the at least one locomotive or control car in the track network, the location or position of the at least one railroad car in the track network, the location or position of a target in the track network, and the location or position of the target with respect to the location or position of the train in the track network or the location or position of the at least one locomotive or control car in the track network, or any combination thereof; and generating stopping data representing an amount of force for stopping the train at a distance from the target based on the movement data and the location data.

Clause 14. The method of clause 13, further comprising: determining or receiving force data representing an amount of force for maintaining the speed of the train.

Clause 15. The method of clause 13 or 14, further comprising: determining or receiving throttle or braking data representing an amount of throttle application or an amount of brake application for providing the amount of force for maintaining the speed of the train.

Clause 16. The method of any of clauses 13-15, further comprising: communicating or causing the communication of a command to apply the throttle or the brake based on the throttle or braking data.

Clause 17. The method of any of clauses 13-16, further comprising: determining or receiving movement data representing that the acceleration of the train is substantially zero, wherein the stopping data is generated based on the movement data representing that the acceleration of the train is substantially zero.

Clause 18. The method of any of clauses 13-17, further comprising: generating braking data representing an amount of brake application for providing the amount of force for stopping the train at the distance from the target.

Clause 19. The method of any of clause 13-18, further comprising: communicating or causing the communication of a command to apply the brake based on the braking data.

Clause 20. The method of any of clauses 13-19, further comprising: automatically communicating or causing the communication of a command to cancel the command to apply the brake based on the stopping data in response to a user action.

Clause 21. The method of any of clauses 13-20, further comprising: determining or receiving movement data representing a deceleration of the train in response to the command to apply the brake based on the braking data; and generating a predictor data representing where the train is estimated or predicted to stop in the track network based on the movement data representing the deceleration of the train.

Clause 22. The method of any of clause 13-21, further comprising: adjusting the braking data representing the amount of brake application for providing the amount of force for stopping the train at the distance from the target based on the predictor data.

Clause 23. The method of any of clauses 13-22, further comprising: preventing the communication or cause the communication of the command to apply the brake when at least one of the speed of the train violates a threshold speed and a distance of the location or position of the target with respect to the location or position of the train in the track network or the location or position of the at least one locomotive or control car in the track network violates a distance threshold.

Clause 24. The system of any of clauses 13-23, wherein the location data further represents a grade of the track under at least a portion of the train.

Clause 25. A train control system for a train having at least one locomotive or control car and, optionally, at least one railroad car, operating in a track network, the system comprising: on the at least one locomotive or control car: an on-board computer programmed or configured to implement or facilitate at least one train action; a communication device in communication with the on-board computer and programmed or configured to receive, transmit, and/or process data signals; and at least one database in communication with the on-board computer with railway data stored therein; wherein the on-board computer of the at least one locomotive or control car is programmed or configured to: determine or receive management data representing at least one of the following planned for a future period of time: a brake application, a throttle application, or any combination thereof; determine or receive location data representing at least one of the following: the location or position of the train in the track network, the location or position of the at least one locomotive or control car in the track network, the location or position of the at least one railroad car in the track network, or any combination thereof; determine or receive movement data representing at least one of the following: a speed of the train, an acceleration of the train, or any combination thereof; and generate predictor data representing an estimated or predicted location or position of the train the track network, the location or position of the at least one locomotive or control car in the track network, the location or position of the at least one railroad car in the track network, or any combination thereof during the future period of time based on the management data, the location data, and the movement data.

Clause 26. A computer-implemented train control method for a train having at least one locomotive or control car and, optionally, at least one railroad car, operating in a track network, the method comprising: determining or receiving management data representing at least one of the following planned for a future period of time: a brake application, a throttle application, or any combination thereof; determining or receiving location data representing at least one of the following: the location or position of the train in the track network, the location or position of the at least one locomotive or control car in the track network, the location or position of the at least one railroad car in the track network, or any combination thereof; determining or receiving movement data representing at least one of the following: a speed of the train, an acceleration of the train, or any combination thereof; and generating predictor data representing an estimated or predicted location or position of the train in the track network, the location or position of the at least one locomotive or control car in the track network, the location or position of the at least one railroad car in the track network, or any combination thereof during the future period of time based on the management data, the location data, and the movement data.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
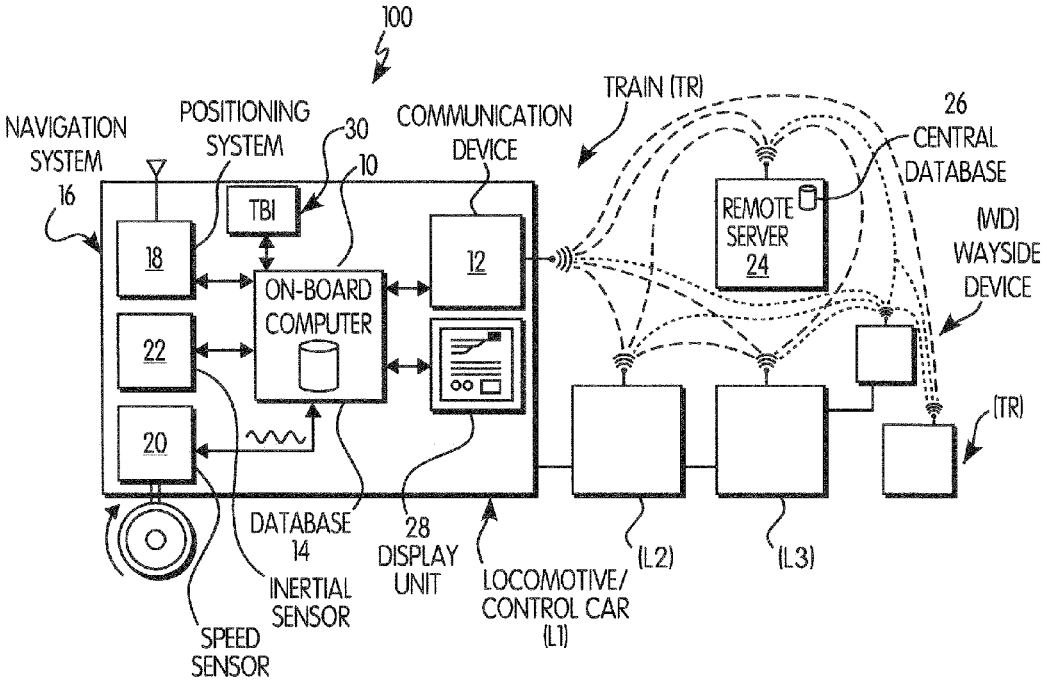
FIG. 1 is a schematic view of a train control system according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track)) between two units, such as two locomotive units or control cars. In one preferred and non-limiting embodiment or aspect, the "communication device" is a radio transceiver programmed, configured, or adapted to wirelessly transmit and receive radio frequency signals and data over a radio signal communication path.

The present invention, including the various computer-implemented and/or computer-designed aspects and configures, may be implemented on a variety of computing devices and systems, wherein these computing devices include the appropriate processing mechanisms and computer-readable media for storing and executing computer-readable instructions, such as programming instructions, code, and the like. In addition, aspects of this invention may be implemented on existing controllers, control systems, and computers integrated or associated with, or positioned on, a locomotive or control car and/or any of the railroad cars. For example, the presently-invented system or any of its functional components can be implemented wholly or partially on a train management computer, a Positive Train Control computer, an on-board controller or computer, a railroad car computer, and the like. In addition, the presently-invented systems and methods may be implemented in a laboratory environment in one or more computers or servers. Still further, the functions and computer-implemented features of the present invention may be in the form of software, firmware, hardware, programmed control systems, microprocessors, and the like.

The control system and computer-implemented control method described and claimed herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars (L) that make up a train (TR). It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight trains, push-pull train configurations, and/or other train arrangements and systems. Still further, the train (TR) may be separated into different configurations (e.g., other trains (TR)) and moved in either the first direction A and/or the second direction B. Any configuration or arrangement of locomotives, control cars, and/or railroad cars may be designated as a train and/or a consist. Still further, it is to be expressly understood that the presently-invented methods and systems described herein may be implemented on and/or used in connection with an auxiliary vehicle, such as an auxiliary railroad vehicle, a maintenance vehicle or machine, a road vehicle (e.g., truck, pick-up truck, car, or other machine), a vehicle equipped to ride on the rails of the track, and/or the like.

In one preferred and non-limiting embodiment or aspect, the methods and systems described herein are used in connection with the locomotives or controls cars (L) that are positioned on each end of the train (TR), while in other preferred and non-limiting embodiments, the methods and systems described herein are used in connection with locomotives or control cars (L) that are positioned intermediately in the train (TR) (since these intermediate locomotives or control cars (L) may eventually become a controlling locomotive or control car (L) when the train (TR) is reconfigured). It is also noted that the methods and systems described herein may be used in connection with "electrical multiple unit" (EMU) or "diesel multiple unit" (DMU) configurations, where a locomotive does not technically exist, but multiple control cars would still be present. Still further, the train (TR) may include only one locomotive or control car (L) and/or some or no railroad cars. Also, as discussed above, the methods and systems described herein may be used in connection with any vehicle type operating in the railway network.

Accordingly, and in one preferred and non-limiting embodiment or aspect, and as illustrated in FIG. 1, the system architecture used to support the functionality of at least some of the methods and systems described herein includes a train management computer or on-board computer 10 (which performs calculations for or within the Positive Train Control (PTC) system, including navigation calculations), a communication device 12 or data radio (which may be used to facilitate the communications between the on-board computers 10 in one or more of the locomotives or control cars (L) of a train (TR), communications with a wayside device (WD), e.g., signals, switch monitors, and the like, and/or communications with a remote server, e.g., a back office server, a central controller, central dispatch, and the like), a track database 14 (which may include track and/or train information and data, such as information about track positions or locations, switch locations or information, signal information, track heading changes, e.g., curves, distance measurements, train information, e.g., the number of locomotives, the number of cars, the number of conventional passenger cars, the number of control cars, the total length of the train, the specific identification numbers of each locomotive or control car (L) where PTC equipment (e.g., an on-board computer 10) is located, and the like), and a navigation system 16 (optionally including a positioning system 18 (e.g., a Global Positioning System (GPS)), a wheel tachometer/speed sensor 20, and/or at least one inertial sensor 22 (e.g., a rotational sensor, an accelerometer, a gyroscope, and the like) that is configured to measure the rate of heading change for the locomotive or control car (L), such as a PTC-equipped locomotive or control car (L)). Further, a display unit 28 may be provided in the locomotive or control car (L) to visually display information and data to the operator, as well as display information and data input by the user.

In some embodiments, a throttle brake interface (TBI) 30 can be provided as a connection between PTC and the throttle and brakes of the train (TR) such that PTC can control the throttle and brakes. For example, the TBI 30 includes software and hardware for communicating and/or converting commands from the on-board computer 10 to the throttle and brakes of the train (TR) such that the on-board computer 10 can control the throttle and brakes. In some examples, the on-board computer 10 (or PTC) can be connected to the locomotive and/or automatic brakes via the TBI 30. The TBI can include circuitry that connects the throttle wires and braking control pipes of the train (TR) to the on-board computer. In another embodiment or aspect, the on-board computer 10 can be given direct control of the throttle and brakes of the train (TR), e.g., by modifying the on-board computer 10 to perform the software and hardware functions of the TBI or by providing a direct software and/or hardware connection from the on-board computer 10 to control the throttle and brakes of the train (TR).

Figure 2:
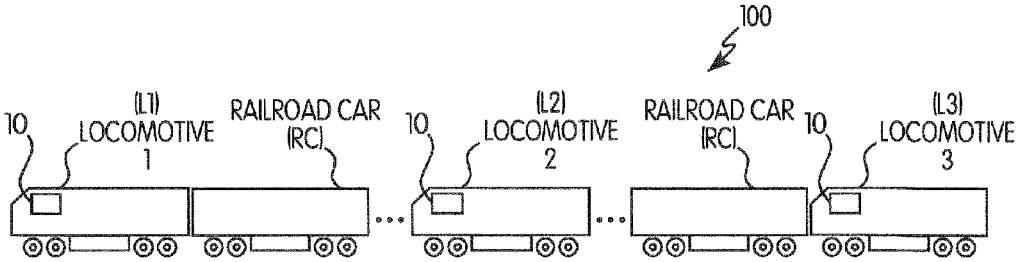
FIG. 2 is a schematic view of a train control system according to the principles of the present invention.
Figure 3:
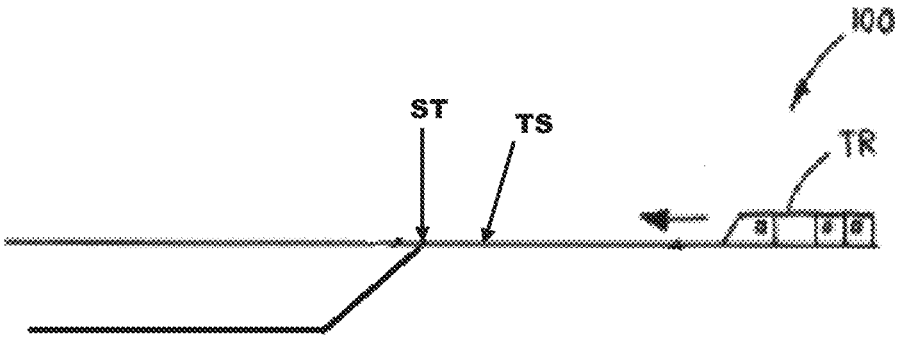
FIG. 3 is a schematic view of a train control system according to the principles of the present invention.

Accordingly, and in one preferred and non-limiting embodiment or aspect, provided is a control system 100 for a train (TR) having at least one locomotive (L), such as a first locomotive or control car (L1). Optionally, the train (TR) may include one or more second locomotives or control cars ((L2), (L3)) and/or one or more railroad cars (RC), as illustrated in FIG. 2. In one embodiment or aspect, the train (TR) is traversing a track section (TS), which may include a stop target (ST), such as a switch or a signal, as shown in FIG. 3. An on-board computer 10 is positioned on or integrated with one or more of the locomotives or control cars ((L1), (L2), and/or (L3)), and the on-board computer 10 is programmed or configured to implement or facilitate at least one train action. Further, the one or more locomotives or control cars ((L1), (L2), and/or (L3)) are equipped with a communication device 12 that is in direct or indirect communication with the on-board computer 10 and programmed or configured to receive, transmit, and/or process data signals. At least one database 14 (e.g., a track database) is accessible by the on-board computer 10 and populated with railway data, such as train data and/or track data or information.

Figure 4:
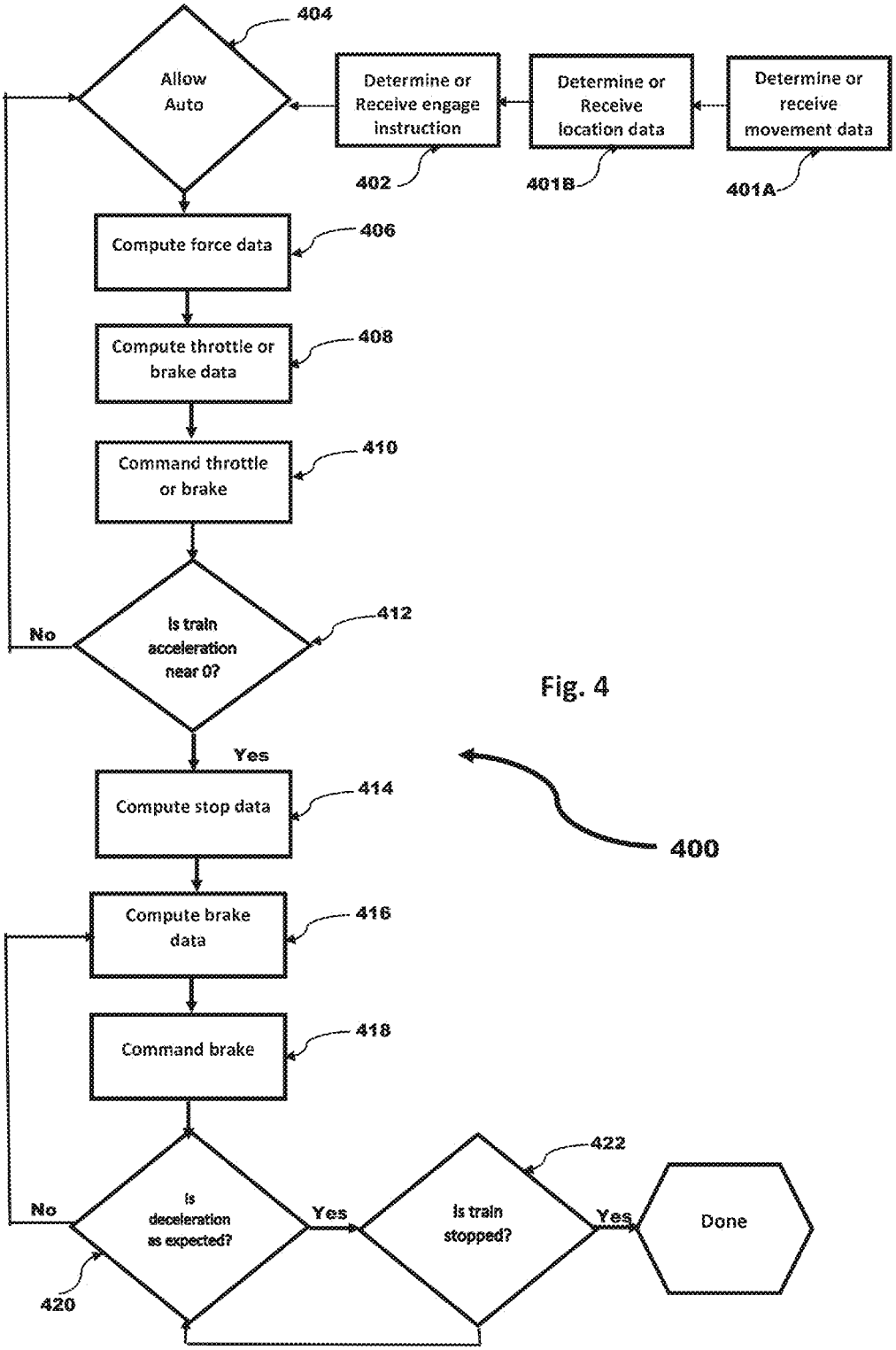
FIG. 4 is a flow chart illustrating a train control method according to the principles of the present invention.

With continued reference to FIGS. 1-3, and with further reference to FIG. 4, the on-board computer 10 of the at least one locomotive (e.g., the on-board computer 10 of at least one of the locomotives or control cars ((L1), (L2), and/or (L3)) is programmed or configured to determine or receive an instruction to use train control to control the train (TR) to stop with respect to a stop target (ST) in a track section (TS) of the track network, e.g., engage auto-approach function 400 in FIG. 4.

In one preferred and non-limiting embodiment or aspect, the on-board computer 10 is programmed or configured to determine or receive movement data representing at least one of the following: a speed of the train (TR), an acceleration of the train (TR), or any combination thereof. For example, in scenario 401A in FIG. 4, the on-board computer 10 can determine or receive the movement data based on data received from the navigation system 16, the database 14, and/or the remote server 24. In some examples, the speed sensor 20 can provide the data representing the speed of the train (TR) to the on-board computer 10 and the inertial sensor 22 can provide the data representing acceleration of the train (TR) to the on-board computer 10. In some examples, the positioning system 18 can provide one or both of the data representing the speed of the train (TR) and the data representing the acceleration of the train (TR) to the on-board computer 10. The on-board computer 10 can determine or receive the movement data continuously, periodically, at specified times, or at specified locations of the train (TR). For example, the on-board computer 10 can continuously determine or receive the movement data throughout the entire auto-approach function 400 in FIG. 4 such that the movement data used for generating or computing data used in the auto-approach function 400 is updated on a continuous basis.

Further, in one preferred and non-limiting embodiment or aspect, the on-board computer 10 is programmed or configured to determine or receive location data representing at least one of the following: the location or position of the train (TR) in the track network, the location or position of the at least one locomotive or control car ((L1), (L2), and/or (L3)) in the track network, the location or position of a stop target (ST) in the track network, and the location or position of the stop target (ST) with respect to the location or position of the train (TR) in the track network or the location or position of the at least one locomotive or control car ((L1), (L2), and/or (L3)) in the track network, a grade of a portion of the track, e.g., a grade of the track under at least a portion of the train, train bulletins and authorities, or any combination thereof. For example, in scenario 401B in FIG. 4, the on-board computer 10 can determine or receive the location data based on data received from the navigation system 16, the database 14, the remote server 24, and/or the wayside device (WD). In some examples, data representing the location or position of the train (TR) in the track network and/or the location or position of the at least one locomotive or control car ((L1), (L2), and/or (L3)) in the track network is received from the positioning system 18. In some examples, data representing the location or position of a stop target (ST) in the track network is received from the database 14, the remote server 24, or the wayside device (WD). In one example, the on-board computer 10 can determine or compute the location or position of the stop target (ST) with respect to the location or position of the train (TR) in the track network or the location or position of the at least one locomotive or control car ((L1), (L2), and/or (L3)) in the track network based on the data representing the train or locomotive location or position received from the positioning system 18 and the data representing the stop target location or position received from the database 14, the remote server 24, or the wayside device (WD). The on-board computer 10 can determine or receive the location data continuously, periodically, at specified times, or at specified locations of the train (TR). For example, the on-board computer 10 can continuously determine or receive the location data throughout the entire auto-approach function 400 in FIG. 4 such that the location data used for generating or computing data used in the auto-approach function 400 is updated on a continuous basis.

In one preferred and non-limiting embodiment or aspect, the on-board computer 10 is programmed or configured to determine or receive an instruction to use train control to control the train (TR) to stop with respect to the stop target (ST). For example, in scenario 402 in FIG. 4, the on-board computer 10 determines or receives an instruction to engage the auto-approach function 400. The display 28 can provide the crew with a button, which when actuated, engages the auto-approach function 400. In some examples, the on-board computer 10 can automatically initiate the auto-approach function 400, e.g., if the on-board computer 10 determines that the speed of the train (TR) satisfies a threshold speed and a distance of the train (TR) from the stop target (ST) satisfies a threshold distance. For example, in the absence of any input from the crew when the train is approaching the stop target (ST), e.g., for a predetermined period of time or distance, the on-board computer 10 can determine to automatically initiate the auto-approach function 400 to stop the train (TR) before the stop target (ST) and, thus, avoid a full-service penalty brake application in a case of continued absence of crew control.

Figure 5:
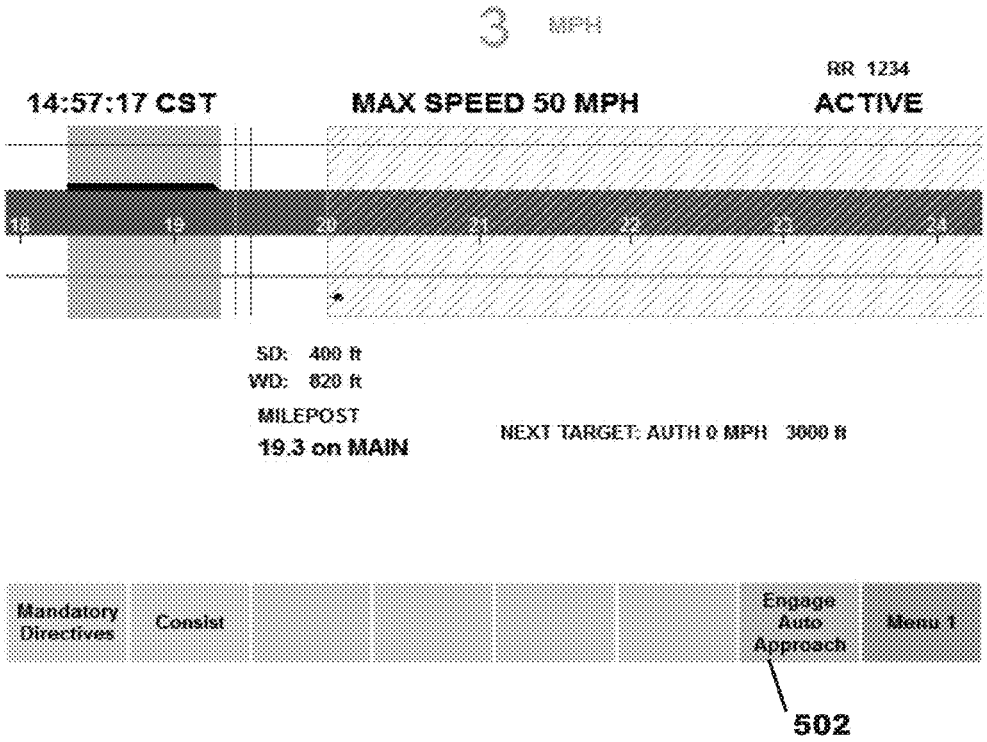
FIG. 5 illustrates an example user interface of a train control system according to the principles of the present invention.
Figure 6:
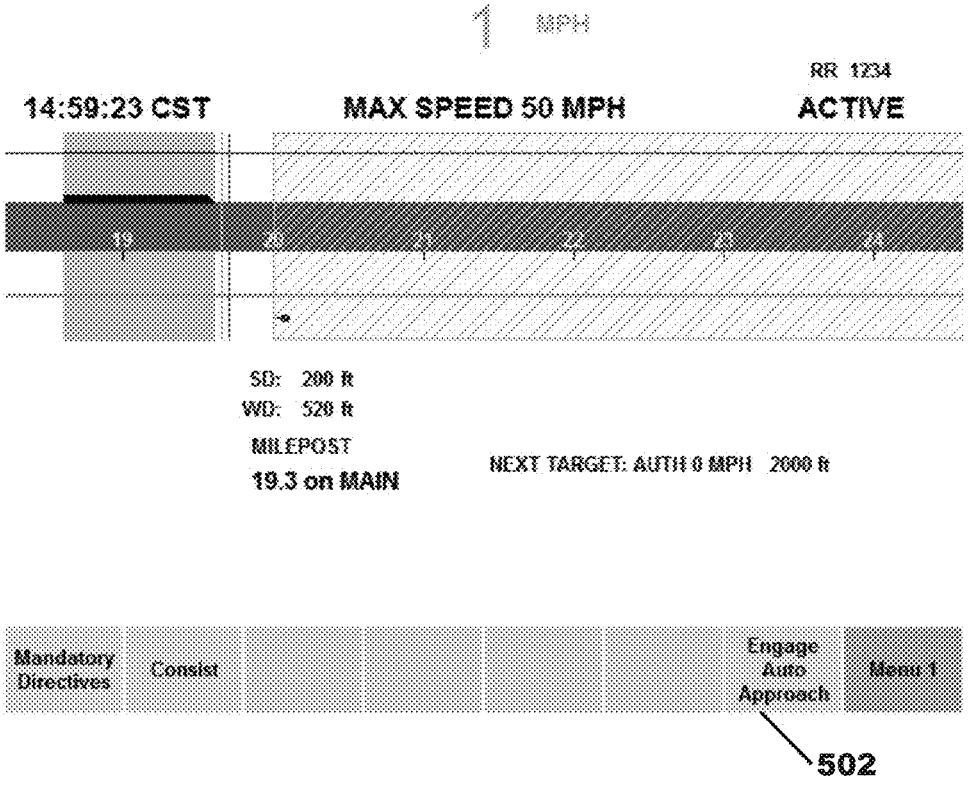
FIG. 6 illustrates an example user interface of a train control system according to the principles of the present invention.
Figure 7:
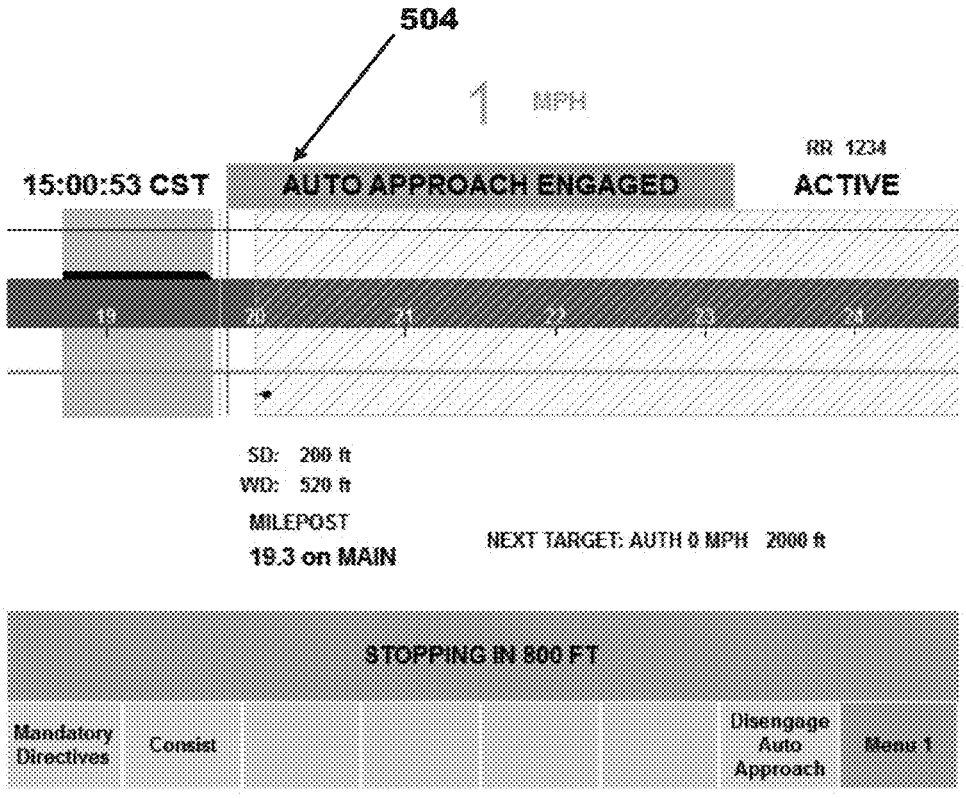
FIG. 7 illustrates an example user interface of a train control system according to the principles of the present invention.

In one preferred and non-limiting embodiment or aspect, the on-board computer 10 is programmed or configured to prevent train control from controlling the train to stop at the distance from the stop target (ST), e.g., prevent engagement of the auto-approach function 400, when the speed of the train (TR) violates a threshold speed, e.g., above 2 mph, and the distance of the train (TR) from the stop target (ST) violates a threshold distance, e.g., outside 2000 ft. For example, in scenario 404 in FIG. 4, the on-board computer 10 determines if the speed of the train is above the threshold speed and if the distance between the train and the stop target (ST) is greater than the threshold distance. If either the threshold speed or threshold distance is violated, the on-board computer 10 prevents engagement of the auto-approach function 400 (e.g., by not providing the button or indicating that the auto-approach function 400 is unavailable) and processing returns to waiting for an engagement instruction. For example, as shown in FIG. 5, the speed of the train (TR) is too great and/or the distance of the train (TR) from the stop target (ST) is too far and, thus, the button 502 for engaging the auto-approach function is not available, i.e., not lit up. If the threshold speed and threshold distance is not violated, the on-board computer 10 can begin to use train control to control the train (TR) to stop with respect to the stop target (ST), e.g., engage the auto-approach function 400. For example, as shown in FIG. 6, the speed of the train (TR) is not too great and the distance of the train (TR) from the stop target (ST) is not too far and, thus, the button 502 for engaging the auto-approach function 400 is available, i.e., lit up. As shown in FIG. 7, the display unit 28 can provide an indication 504 to the crew that the auto-approach function 400 has been engaged.

In one preferred and non-limiting embodiment or aspect, the on-board computer 10 is programmed or configured to determine or receive force data representing an amount of force for maintaining the speed of the train. The on-board computer 10 can determine or receive the force data based on data received from the navigation system 16, the database 14, and/or the remote server 24. For example, in scenario 406 in FIG. 4, the on-board computer 10 can compute the amount of force needed to maintain the current speed of the train (TR) using physical relationships between the properties of the train (TR), the track section (TS), and the forces acting on the train. For example, the on-board computer 10 can compute the amount of force needed to maintain the current speed of the train based on Newton's second law, i.e., F=ma, and formulas derived therefrom. The computed forces may include grade, curvature, dynamic braking, friction braking, tractive force, resistive force, or any combination thereof. In an example, the on-board 10 computer can use formulas and braking algorithms implemented in various known train control and management systems, e.g., the I-ETMS® of Wabtec Corp. In some examples, the on-board computer 10 can determine or receive a maximum approach speed that sets a maximum speed at which the train is allowed to approach the stop target (ST) and determine or receive force data representing an amount of force for achieving and maintaining the maximum approach speed of the train (TR).

In one preferred and non-limiting embodiment or aspect, the on-board computer 10 is programmed or configured to determine or receive throttle or braking data representing an amount of throttle application or an amount of brake application for providing the amount of force for maintaining the speed of the train. For example, in scenario 408 in FIG. 4, the on-board computer 10 can compute the amount of throttle application and/or the amount of brake application for providing the amount of force for maintaining the current speed (or maximum approach speed) of the train using look-up tables and/or algorithms that correlate the throttle and braking applications of the train (TR) with forces provided thereby. In another example, the on-board computer 10 can compute the amount of throttle application and/or the amount of brake application for maintaining the speed of the train (TR) based on Newton's second law, i.e., F=ma, and formulas derived therefrom. The amount of force needed to maintain the speed of the train may be based on computed forces including grade, curvature, dynamic braking, friction braking, tractive force, resistive force, or any combination thereof. In an example, the on-board 10 computer can use formulas and braking algorithms implemented in various known train control and management systems, e.g., the I-ETMS® of Wabtec Corp.

In one preferred and non-limiting embodiment or aspect, the on-board computer 10 is programmed or configured to communicate or cause the communication of a command to apply the throttle or the brake of the train (TR) based on the throttle or braking data. For example, in scenario 410 in FIG. 4, the on-board computer 10 commands the TBI 30 to apply the throttle or brake of the train (TR) in a manner that maintains the current speed of the train (TR) or achieves and maintains the maximum approach speed of the train (TR). In some examples, the on-board computer 10 directly commands the throttle or brake of the train (TR) in a manner that maintains the current speed of the train (TR) or achieves and maintains the maximum approach speed of the train (TR).

In one preferred and non-limiting embodiment or aspect, the on-board computer 10 is programmed or configured to determine or receive movement data representing that the acceleration of the train is substantially zero. For example, in scenario 412 in FIG. 4, the on-board computer 10 determines, after communication of the command to apply the throttle or the brake of the train (TR), if current train acceleration is substantially zero based on the movement data. If the current train acceleration is not substantially zero, the auto-approach function 400 returns to scenario 406 and determines or receives force data that is updated or adjusted from previous force data and communicates or causes the communication of a command to apply the throttle or the brake of the train (TR) based on updated throttle or braking data computed from the updated force data. If the current train acceleration is substantially zero, train control proceeds to control the train (TR) to stop with respect to a stop target (ST).

In one preferred and non-limiting embodiment or aspect, the on-board computer 10 is programmed or configured to generate stopping data representing an amount of force for stopping the train (TR) at a distance from the stop target (ST) based on the movement data and the location data. The distance from the stop target (ST) may be at the stop target (ST) itself, i.e., a zero distance from the stop target, a distance before the stop target, e.g., 50 feet before the stop target (ST) on a track section (TS) of the track network, or a distance after the stop target, e.g., 50 feet after the stop target (ST) on a track section (TS) of the track network. In some examples, the distance from the stop target (ST) is a predetermined distance, e.g., a distance set based upon safety regulations, characteristics of the train (TR) or locomotive or control car ((L1), (L2), and/or (L3)), characteristics of the track section (TS) and/or the track network, crew input to the control system, or any combination thereof. In some examples, the distance from the stop target (ST) can be dynamically set by the on-board computer 10, e.g., as the train (TR) approaches the stop target (ST), based on the movement data, the location data, characteristics of the train (TR) or locomotive or control car ((L1), (L2), and/or (L3)), e.g., train weight or braking ability, characteristics of the track section (TS) and/or the track network, crew input to the control system, or any combination thereof.

In one preferred and non-limiting embodiment or aspect, for example, in scenario 414 in FIG. 4, the on-board computer 10 generates or computes the stopping data using physical relationships between the properties and location of the train (TR) and the track section (TS), the forces acting on the train, and planned forces. The on-board computer 10 can use a predictor or braking model or algorithm to build or determine stopping data for stopping distances as the train advances or travels through the track network. The stopping data and stopping distances are based upon certain specified train-based operating parameters and/or variable feedback from a number of sensor systems and/or ancillary measurements or determinations, e.g., track grade, track curvature, train speed, train weight, brake pipe pressure, braking system reservoir pressures, planned throttle application and capability, planned braking application and capability, and the like. Accordingly, the predictor or braking model accounts for those various parameters, but also accounts for variation in the system parameters while providing stopping data and a stopping distance, e.g., for stopping the distance from the stop target (ST), that has a very low probability of stopping the train past the distance from the stop target (ST).

In one preferred and non-limiting embodiment or aspect, this stopping data and stopping distance is used to build a braking profile or curve that estimates or predicts when and where the train (TR) will stop in the track network, e.g., at the distance from the stop target (ST) that is positioned ahead on the track. This predictor or braking profile is continually calculated using the braking model and using the changing feedback and variable determinations to provide an updated braking profile or curve ahead of the train. In general, this braking profile or curve visually illustrates to the train operator where the train is predicted to stop. Again, this predictor or braking profile or curve is continually (e.g., 1-3 times per second) updated so that the crew has an ongoing understanding of how and when the train is going to stop during the auto-approach function 400. The on-board computer 10 can build the braking profile or curve using Newton's second law, i.e., F=ma, and formulas derived therefrom, based on the stopping data and the stopping distance. In an example, the on-board 10 computer can use formulas and braking algorithms implemented in various known train control and management systems, e.g., the I-ETMS® of Wabtec Corp.

In one preferred and non-limiting embodiment or aspect, the on-board computer 10 is programmed or configured to generate or compute braking data representing an amount of brake application for providing the amount of force for stopping the train at the distance from the target. The on-board computer 10 can calculate the braking profile or curve to visually illustrate to the train operator where the train is predicted to stop based on the braking data representing an amount of brake application for providing the amount of force for stopping the train at the distance from the target. For example, in scenario 416 in FIG. 4, the on-board computer 10 can compute the braking data representing an amount of brake application for providing the amount of force for stopping the train at the distance from the stop target (ST) using look-up tables and/or algorithms that correlate the braking applications of the train (TR) with forces provided thereby. In another example, the on-board computer 10 can generate or compute the braking data representing the amount of brake application for providing the amount of force for stopping the train at the distance from the target using Newton's second law, i.e., F=ma, and formulas derived therefrom, based on the above described forces and the braking profile or curve. In an example, the on-board computer 10 can use formulas and braking algorithms implemented in various known train control and management systems, e.g., the I-ETMS® of Wabtec Corp.

Further, in one preferred and non-limiting embodiment or aspect, the on-board computer 10 can communicate or cause the communication of a command to apply the brake based on the braking data. For example, in scenario 418 in FIG. 4, the on-board computer 10 commands the TBI 30 to apply the throttle or brake of the train (TR) in a manner that stops the train (TR) at the distance from the stop target (ST). In some examples, the on-board computer 10 directly commands the brake of the train (TR) in a manner that stops the train (TR) at the distance from the stop target (ST).

In one preferred and non-limiting embodiment or aspect, the on-board computer 10 is programmed or configured to continually calculate the predictor or braking profile using the changing feedback and variable determinations to provide a continuously updated predictor or braking profile or curve ahead of the train. For example, the on-board computer 10 can continue to determine or receive movement data representing a deceleration of the train in response to the command to apply the brake based on the braking data and generate or compute predictor data representing where the train (TR) is estimated or predicted to stop in the track network based on the movement data representing the deceleration of the train (TR). In scenario 420 in FIG. 4, if the deceleration of the train in response to the command to apply the brake does not follow the predictor or braking profile or curve, the on-board computer 10 adjusts or modifies the braking data based on the movement data, the location data, the previous braking data, and the predictor or braking model or algorithm. For example, the auto-approach function 400 can return to scenario 416 to compute updated braking data and communicate a new command based on the updated braking data to the brakes of the train (TR) that accounts for the previous variation from the predictor data.

Figure 8:
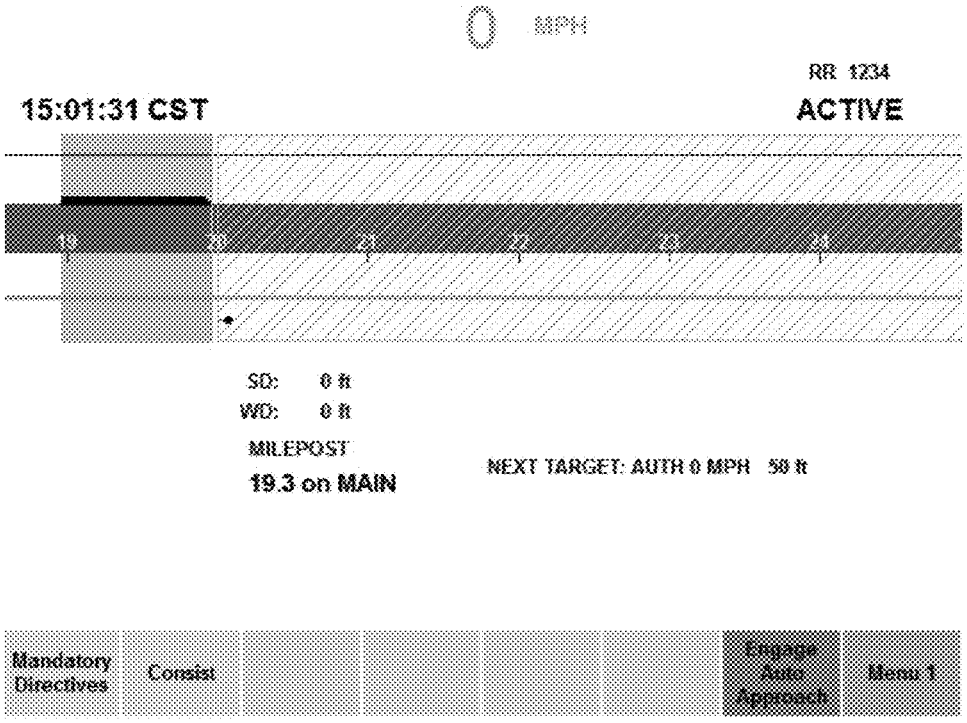
FIG. 8 illustrates an example user interface of a train control system according to the principles of the present invention.

In one preferred and non-limiting embodiment or aspect, the on-board computer 10 is programmed or configured to continually compare the actual behavior of the train to the predictor or braking profile or curve at least until the train is stopped. For example, in scenario 422 in FIG. 4, the on-board computer 10 determines if the train is stopped at an acceptable distance from the stop target (ST). If the train is determined to be stopped at the acceptable distance, the auto-approach function 400 is automatically disengaged, which is indicated to the crew along with the position of the train by the display unit 28 as shown in FIG. 8. If the train is still approaching the stop target (ST) or not at an acceptable stopping distance, the on-board computer 10 continues to analyze the braking profile or curve and, when necessary, to adjust or modify the braking data.

In some examples, the on-board computer 10 can be configured to automatically communicate or cause the communication of a command to cancel generation of the force data or the command to apply the brake based on the stopping data in response to a user action. For example, the on-board computer 10 can be configured to automatically cancel train control for stopping at the distance from the stop target (ST), e.g., disengage the auto-approach function 400, in response to a crew action, such as manual movement of the throttle or manual movement of the brake handle by the crew.

In this manner, preferred and non-limiting embodiments provide an improved train control system and method. PTC nuisance warnings and false enforcements that are conventionally issued when the crew attempts to advance closer to a stop target can be eliminated, because the train control knows and/or controls what the control inputs, e.g., throttle and braking, will be when approaching the stop target (ST) and can model train behavior with braking calculations and predictor curves that do not have to assume constant values for a set period of time. Accordingly, railroad productivity is improved and user/crew experience with PTC is enhanced.

Figure 9:
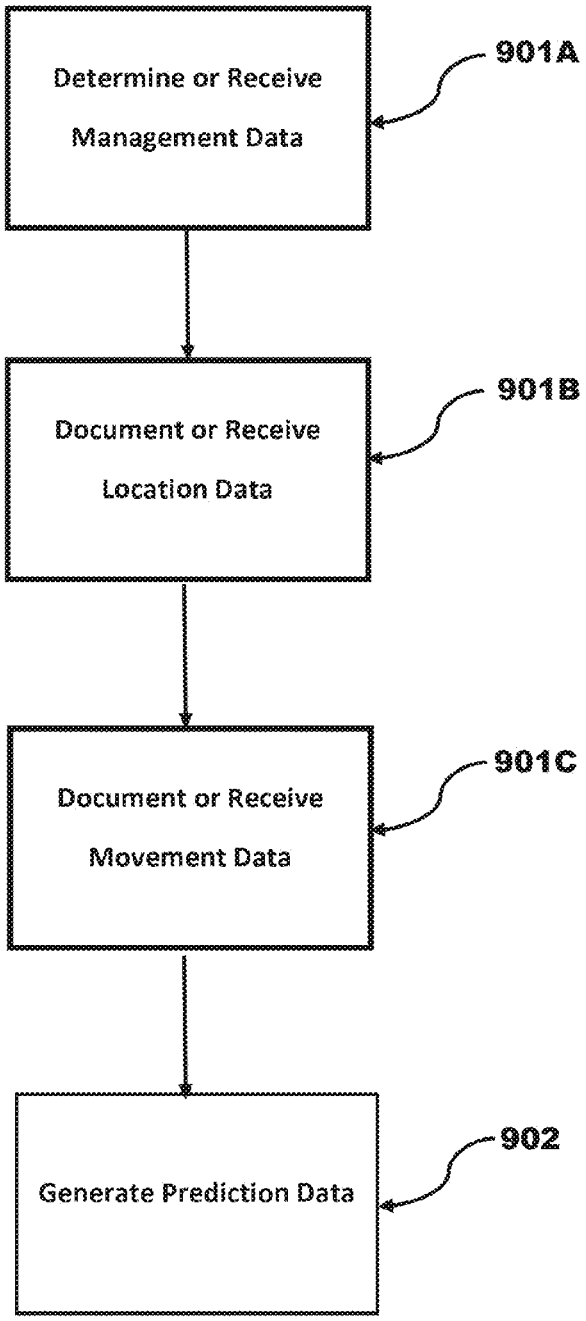
FIG. 9 is a flow chart illustrating a train control method according to the principles of the present invention.

Referring again to FIGS. 1-3, and with further reference to FIG. 9, in one preferred and non-limiting embodiment or aspect, the on-board computer 10 of the at least one locomotive (e.g., the on-board computer 10 of at least one of the locomotives or control cars ((L1), (L2), and/or (L3)) is programmed or configured to communicate with and/or be coupled to an energy management (EM) system of the train (TR) and to use train control to control the train (TR) based on energy management data representing an energy management plan for a future period of time received from the EM system. The energy management system may be a software application executed by the on-board computer 10, but may take on other forms, including an independent device, or software executed on any other computing device in communication with the on-board computer 10. The energy management system may implement cruise control features and issue control commands. In some examples, the energy management system can be programmed or configured to transition the locomotive engine to an auto control start position or state (e.g., an IDLE position or state) to save fuel, for example, if it is determined that the engine does not need the current level of horsepower.

The energy management data represents how the EM system plans to drive the train during a future period of time, e.g., for the next 75 seconds. Accordingly, the train control system, e.g., PTC, can use this plan to know how the throttle and braking controls will be affected by the EM plan, which enables PTC predictions to be more accurate and nuisance warnings to be reduced. For example, in scenario 901A in FIG. 9, the on-board computer 10 can be programmed or configured to determine or receive management data representing at least one of the following planned for a future period of time: a brake application of the (TR), a throttle application of the (TR), or any combination thereof. Further, in scenario 901B in FIG. 9, the on-board computer 10 can be programmed or configured to determine or receive location data representing at least one of the following: the location or position of the train in the track network, the location or position of the at least one locomotive or control car in the track network, or any combination thereof. In scenario 901C, the on-board computer can be programmed or configured to determine or receive movement data representing at least one of the following: a speed of the train (TR), an acceleration of the train (TR), or any combination thereof.

In one preferred and non-limiting embodiment or aspect, the on-board computer 10 can be programmed or configured to generate predictor data representing an estimated or predicted location or position of the train the track network, the location or position of the at least one locomotive or control car in the track network, or any combination thereof during the future period of time based on the management data, the location data, and the movement data. For example, in scenario 902 in FIG. 9, the on-board computer 10 generates or computes the predictor data using physical relationships between the properties and location of the train (TR) and the track section (TS), the forces acting on the train, and planned forces. The on-board computer 10 can use a predictor or braking model or algorithm as described above with respect to the force data for stopping the train to build or determine a predictor profile or curve that estimates or predicts train behavior during the EM system plan.

In this manner, preferred and non-limiting embodiments provide an improved control system and method for a train. PTC nuisance warnings and false enforcements that are conventionally issued because PTC is unaware how the EM system plans to drive the train can be avoided and more accurate train control predictor data is achieved, because the train control knows and/or controls what the control inputs, e.g., throttle and braking, will be during the period of EM system control.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A train control system for a train having at least one locomotive or control car and, optionally, at least one railroad car, operating in a track network, the system comprising:

on the at least one locomotive or control car:

an on-board computer programmed or configured to implement or facilitate at least one train action;

a communication device in communication with the on-board computer and programmed or configured to receive, transmit, and/or process data signals; and at least one database in communication with the on-board computer with railway data stored therein;

wherein the on-board computer of the at least one locomotive or control car is programmed or configured to:

determine or receive movement data representing at least one of the following: a speed of the train, an acceleration of the train, or any combination thereof;

determine or receive location data representing at least one of the following:

the location or position of the train in the track network, the location or position of the at least one locomotive or control car in the track network, the location or position of the at least one railroad car in the track network, the location or position of a target in the track network, and the location or position of the target with respect to the location or position of the train in the track network or the location or position of the at least one locomotive or control car in the track network, or any combination thereof;

generate stopping data representing an amount of force for stopping the train at a distance from the target based on the movement data and the location data.

2. The system of claim 1, wherein the on-board computer of the at least one locomotive or control car is programmed or configured to:

determine or receive force data representing an amount of force for maintaining the speed of the train.

3. The system of claim 2, wherein the on-board computer of the at least one locomotive or control car is programmed or configured to:

determine or receive throttle or braking data representing an amount of throttle application or an amount of brake application for providing the amount of force for maintaining the speed of the train.

4. The system of claim 3, wherein the on-board computer of the at least one locomotive or control car is programmed or configured to:

communicate or cause the communication of a command to apply the throttle or the brake based on the throttle or braking data.

5. The system of claim 4, wherein the on-board computer of the at least one locomotive or control car is programmed or configured to:

determine or receive movement data representing that the acceleration of the train is substantially zero, wherein the stopping data is generated based on the movement data representing that the acceleration of the train is substantially zero.

6. The system of claim 1, wherein the on-board computer of the at least one locomotive or control car is programmed or configured to:

generate braking data representing an amount of brake application for providing the amount of force for stopping the train at the distance from the target.

7. The system of claim 6, wherein the on-board computer of the at least one locomotive or control car is programmed or configured to:

communicate or cause the communication of a command to apply the brake based on the braking data.

8. The system of claim 7, wherein the on-board computer of the at least one locomotive or control car is programmed or configured to:

automatically communicate or cause the communication of a command to cancel the command to apply the brake based on the stopping data in response to a user action.

9. The system of claim 7, wherein the on-board computer of the at least one locomotive or control car is programmed or configured to:

determine or receive movement data representing a deceleration of the train in response to the command to apply the brake based on the braking data; and generate predictor data representing where the train is estimated or predicted to stop in the track network based on the movement data representing the deceleration of the train.

10. The system of claim 9, wherein the on-board computer of the at least one locomotive or control car is programmed or configured to:

adjust the braking data representing the amount of brake application for providing the amount of force for stopping the train at the distance from the target based on the predictor data.

11. The system of claim 7, wherein the on-board computer of the at least one locomotive or control car is programmed or configured to:

prevent the communication or cause the prevention of the communication of the command to apply the brake when at least one of the speed of the train violates a threshold speed and a distance of the location or position of the target with respect to the location or position of the train in the track network or the location or position of the at least one locomotive or control car in the track network violates a distance threshold.

12. The system of claim 1, wherein the location data further represents a grade of the track under at least a portion of the train.

13. A computer-implemented train control method for a train having at least one locomotive or control car and, optionally, at least one railroad car, operating in a track network, the method comprising:

determining or receiving movement data representing at least one of the following: a speed of the train, an acceleration of the train, or any combination thereof;

determining or receiving location data representing at least one of the following: the location or position of the train in the track network, the location or position of the at least one locomotive or control car in the track network, the location or position of the at least one railroad car in the track network, the location or position of a target in the track network, and the location or position of the target with respect to the location or position of the train in the track network or the location or position of the at least one locomotive or control car in the track network, or any combination thereof; and generating stopping data representing an amount of force for stopping the train at a distance from the target based on the movement data and the location data.

14. The method of claim 13, further comprising:

determining or receiving force data representing an amount of force for maintaining the speed of the train.

15. The method of claim 14, further comprising:

determining or receiving throttle or braking data representing an amount of throttle application or an amount of brake application for providing the amount of force for maintaining the speed of the train.

16. The method of claim 15, further comprising:

communicating or causing the communication of a command to apply the throttle or the brake based on the throttle or braking data.

17. The method of claim 16, further comprising:

determining or receiving movement data representing that the acceleration of the train is substantially zero, wherein the stopping data is generated based on the movement data representing that the acceleration of the train is substantially zero.

18. The method of claim 13, further comprising:

generating braking data representing an amount of brake application for providing the amount of force for stopping the train at the distance from the target.

19. The method of claim 18, further comprising:

communicating or causing the communication of a command to apply the brake based on the braking data.

20. The method of claim 19, further comprising:

automatically communicating or causing the communication of a command to cancel the command to apply the brake based on the stopping data in response to a user action.

21. The method of claim 19, further comprising:

determining or receiving movement data representing a deceleration of the train in response to the command to apply the brake based on the braking data; and generating a predictor data representing where the train is estimated or predicted to stop in the track network based on the movement data representing the deceleration of the train.

22. The method of claim 21, further comprising:

adjusting the braking data representing the amount of brake application for providing the amount of force for stopping the train at the distance from the target based on the predictor data.

23. The method of claim 19, further comprising:

preventing the communication or causing the prevention of the communication of the command to apply the brake when at least one of the speed of the train violates a threshold speed and a distance of the location or position of the target with respect to the location or position of the train in the track network or the location or position of the at least one locomotive or control car in the track network violates a distance threshold.

24. The system of claim 13, wherein the location data further represents a grade of the track under at least a portion of the train.

25. A train control system for a train having at least one locomotive or control car and, optionally, at least one railroad car, operating in a track network, the system comprising:

on the at least one locomotive or control car:

an on-board computer programmed or configured to implement or facilitate at least one train action;

a communication device in communication with the on-board computer and programmed or configured to receive, transmit, and/or process data signals; and at least one database in communication with the on-board computer with railway data stored therein;

wherein the on-board computer of the at least one locomotive or control car is programmed or configured to:

determine or receive management data representing at least one of the following planned for a future period of time: a brake application, a throttle application, or any combination thereof;

determine or receive location data representing at least one of the following: the location or position of the train in the track network, the location or position of the at least one locomotive or control car in the track network, the location or position of the at least one railroad car in the track network, or any combination thereof;

determine or receive movement data representing at least one of the following: a speed of the train, an acceleration of the train, or any combination thereof; and generate predictor data representing an estimated or predicted location or position of the train in the track network, the location or position of the at least one locomotive or control car in the track network, the location or position of the at least one railroad car in the track network, or any combination thereof during the future period of time based on the management data, the location data, and the movement data.

26. A computer-implemented train control method for a train having at least one locomotive or control car and, optionally, at least one railroad car, operating in a track network, the method comprising:

determining or receiving management data representing at least one of the following planned for a future period of time: a brake application, a throttle application, or any combination thereof;

determining or receiving location data representing at least one of the following: the location or position of the train in the track network, the location or position of the at least one locomotive or control car in the track network, the location or position of the at least one railroad car in the track network, or any combination thereof;

determining or receiving movement data representing at least one of the following: a speed of the train, an acceleration of the train, or any combination thereof; and generating predictor data representing an estimated or predicted location or position of the train in the track network, the location or position of the at least one locomotive or control car in the track network, the location or position of the at least one railroad car in the track network, or any combination thereof during the future period of time based on the management data, the location data, and the movement data.

27. The system of claim 1, wherein the on-board computer of the at least one locomotive or control car is programmed or configured to:

at least one of issue a warning and control an application of penalty brakes, based on the movement data and the location data;

generate braking data representing an amount of brake application for providing the amount of force for stopping the train at the distance from the target; and engage an auto-approach function, wherein, when the auto-approach function is engaged, the at least one of the issuing of the at least one warning and the performing the application of the penalty brakes is avoided, and the on-board computer communicates or causes the communication of a command to apply locomotive independent brakes based on the braking data.

28. The system of claim 25, wherein the on-board computer of the at least one locomotive or control car is programmed or configured to:

implement a positive train control (PTC) system, wherein the PTC system at least one of issues a warning and controls an application of penalty brakes, based on the movement data and the location data; and communicate with and/or be coupled to an energy management system of the train, wherein the management data represents how the energy management system plans to drive the train during the future period of time.

* * * * *